US006535852B2

(12) United States Patent
Eide

(10) Patent No.: US 6,535,852 B2
(45) Date of Patent: Mar. 18, 2003

(54) TRAINING OF TEXT-TO-SPEECH SYSTEMS

(75) Inventor: Ellen M. Eide, Mt. Kisco, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/821,399

(22) Filed: Mar. 29, 2001

(65) Prior Publication Data

US 2002/0143542 A1 Oct. 3, 2002

(51) Int. Cl.[7] ..... G10L 13/08
(52) U.S. Cl. ..... 704/260; 704/266; 704/268
(58) Field of Search ..... 704/258, 260, 704/266, 267, 268, 270, 275

(56) References Cited

U.S. PATENT DOCUMENTS 5,325,462 A * 6/1994 Farrett ..... 704/258
6,003,005 A * 12/1999 Hirschberg ..... 704/260
6,073,101 A * 6/2000 Maes ..... 704/275
6,101,470 A * 8/2000 Eide et al. ..... 704/260
6,119,086 A * 9/2000 Ittycheriah et al. ..... 704/267
6,163,769 A * 12/2000 Acero et al. ..... 704/260
6,173,262 B1 * 1/2001 Hirschberg ..... 704/260
6,226,606 B1 * 5/2001 Acero et al. ..... 704/218
6,292,778 B1 * 9/2001 Sukkar ..... 704/256

* cited by examiner

*Primary Examiner*—Susan McFadden
(74) *Attorney, Agent, or Firm*—Ference & Associates

(57) ABSTRACT

Building a data-driven text-to-speech system involves collecting a database of natural speech from which to train models or select segments for concatenation. Typically the speech in that database is produced by a single speaker. In this invention we include in our database speech from a multiplicity of speakers.

18 Claims, 1 Drawing Sheet

TRAINING OF TEXT-TO-SPEECH SYSTEMS

FIELD OF THE INVENTION

The present invention relates generally to text-to-speech conversion systems and more particularly to the "training" of such systems.

BACKGROUND OF THE INVENTION

In concatenative speech synthesis systems, small portions of natural speech are spliced together to form synthetic speech waveforms. Each of the portions of original speech has associated with it the original prosody (pitch and duration) contour that was uttered by the speaker. However, when small portions of natural speech arising from different utterances in the database are concatenated, the resulting synthetic speech does not tend to have natural-sounding prosody (i.e., pitch, which is instrumental in the perception of intonation and stress in a word).

A typical approach for combating this problem involves specifying a desired prosodic contour and then either to impose this contour on the synthetic speech using digital signal processing techniques or to select segments whose prosody is naturally close to that contour. In this connection, a set of training data (i.e., speech utterances) is collected to provide the set of segments available for concatenation, as well as the from which to infer the model of prosodic variation used to specify the desired prosodic contour. Typically, those data are provided by a single speaker. However, it has been found that the collection of such data from a single speaker imposes significant limitations on the subsequent efficacy of the text-to-speech system involved.

A need has thus been recognized in connection with facilitating the enrollment of training data for a speech-to-text system in a manner that overcomes the disadvantages and shortcomings of conventional efforts in this regard.

SUMMARY OF THE INVENTION

In accordance with at least one presently preferred embodiment of the present invention, multiple speakers are utilized in obtaining training data. Further, this will preferably involve suitable normalization of the data from each speaker to transform that data to mimic a canonical target speaker. For example, in building a prosodic model, the pitch values for a given utterance are divided by the average pitch over that utterance, yielding relative pitches which are comparable across multiple speakers; a value less than one implies a lowering of the pitch during that portion of the utterance while a value greater than one implies an elevation in pitch.

Broadly contemplated in accordance with at least one embodiment of the present invention are significant differences in comparison with some conventional efforts, in which the user is able to choose from several available voices, such as a man, woman, or child. In that case, completely separate systems are built, each of which relies on training data from a single speaker, i.e. the target voice. A switch may then be used to select one of the systems. However, in accordance with at least one embodiment of the present invention, a single system is built which relies on data from multiple speakers.

In one aspect, the present invention provides a method of constructing a model for use in a text-to-speech synthesis system, the method comprising the steps of obtaining a set of features and a first corresponding observation value from a first training speaker; obtaining the set of features and a second corresponding observation value from a second training speaker; and pooling the first and second corresponding observation values to obtain the model.

In another aspect, the present invention provides a method of constructing a model for use in a text-to-speech synthesis system, the method comprising the steps of: obtaining a set of features and a corresponding observation value from a first training speaker; repeating the step of obtaining a set of features and a corresponding observation value for each of a plurality of additional speakers; and pooling the corresponding observation values, from the first speaker and the additional speakers, to obtain the model.

In an additional aspect, the present invention provides a method for enrolling training data for a text-to-speech synthesis system, the method comprising the steps of: collecting speech data from at least two speakers; ascertaining at least one characteristic relating to the speech data of each speaker; and creating a target range of speech data via transforming the at least one characteristic relating to the speech data of each speaker.

In a further aspect, the present invention provides an apparatus for constructing a model for use in a text-to-speech synthesis system, the apparatus comprising: an obtaining arrangement which obtains a set of features and a first corresponding observation value from a first training speaker; the obtaining arrangement being adapted to obtain the set of features and a second corresponding observation value from a second training speaker; and a pooling arrangement which pools the first and second corresponding observation values to obtain the model.

In another aspect, the present invention provides an apparatus for constructing a model for use in a text-to-speech synthesis system, the apparatus comprising: an obtaining arrangement which obtains a set of features and a corresponding observation value from a first training speaker; the obtaining arrangement being adapted to further obtain a set of features and a corresponding observation value for each of a plurality of additional speakers; and a pooling arrangement which pools the corresponding observation values, from the first speaker and the additional speakers, to obtain the model.

In an additional aspect, the present invention provides an apparatus for enrolling training data for a text-to-speech synthesis system, the apparatus comprising: a collector arrangement which collects speech data from at least two speakers; an ascertaining arrangement which ascertains at least one characteristic relating to the speech data of each speaker, and a target range creator which creates a target range of speech data via transforming the at least one characteristic relating to the speech data of each speaker.

In a further aspect, the present invention provides a program storage device readable by machine, tangibly embodying a program of instructions executable by the machine to perform method steps for constructing a model for use in a text-to-speech synthesis system, the method comprising the steps of: obtaining a set of features and a first corresponding observation value from a first training speaker; obtaining the set of features and a second corresponding observation value from a second training speaker; and pooling the first and second corresponding observation values to obtain the model.

Furthermore, in an additional aspect, the present invention provides a program storage device readable by machine, tangibly embodying a program of instructions executable by the machine to perform method steps for enrolling training data for a text-to-speech synthesis system, the method comprising the steps of collecting speech data from at least two speakers; ascertaining at least one characteristic relating to the speech data of each speaker; and creating a target range of speech data via transforming the at least one characteristic relating to the speech data of each speaker.

For a better understanding of the present invention, together with other and further features and advantages thereof, reference is made to the following description, taken in conjunction with the accompanying drawings, and the scope of the invention will be pointed out in the appended claims.

DESCRIPTION OF THE PREFERRED EMBODIMENTS

Figure 1:
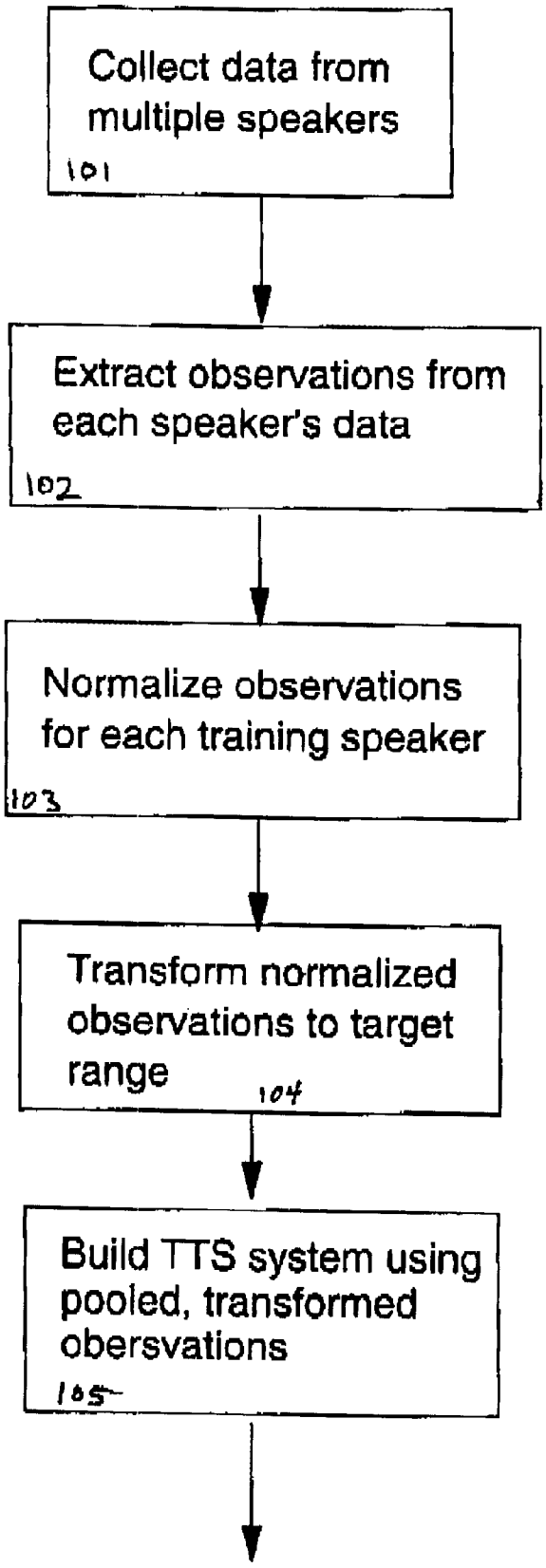
FIG. 1 illustrates a flow chart of a text-to-speech system utilizing multiple speakers for training.

A flow chart of a preferred embodiment of a text-to-speech synthesis system, in accordance with at least one embodiment of the present invention, is shown in FIG. 1.

First a database derived from multiple speakers is collected (101). This step could be realized by acquiring existing data from an outside source, or by enrolling data from speakers directly.

Having collected the data, the observations (i.e., the set of physical parameters extractable from a speech waveform which are to be modeled, e.g. pitch or duration) are preferably extracted at 102 on a speaker-by-speaker or sentence-by-sentence basis (the latter assuming only one speaker per sentence). For example, in building a model of pitch, this step includes tracking the pitch over each sentence.

Once the observations are extracted, they are preferably normalized (103). In building a pitch model, this step includes calculating the average pitch over each sentence and then dividing each pitch value in the sentence by that average.

Having appropriately normalized each observation, each observation is then preferably transformed to the target range (104). The target range is determined by the type of voice that is desired for the output of the TTS (text-to-speech) system. For the pitch model, the target value is the average pitch of the target speaker. The transformation step includes multiplying each normalized pitch value by that target value.

Once the data have been transformed, the TTS system is preferably built in suitable manner, using the transformed data as input (105). Suitable processes for building TTS systems are well known. For example, reference may be made in this connection to Donovan, R. E. and Eide, E. M.,"The IBM Trainable Speech Synthesis System," Proceedings of ICSLP 1998, Sydney, Australia.

In brief recapitulation, it will be appreciated that at least one presently preferred embodiment of the present invention broadly embraces the inclusion of speech from multiple speakers in building a text-to-speech system. Accordingly, this allows for the use of very large, multiple speaker databases (which do exist and are thus readily available) for training the system. As the amount of data available for training a model is increased, the complexity of that model may be increased. Thus, by enabling the use of a large database, the use of more powerful models is also enabled.

In at least one preferred embodiment, the speech from a given speaker is normalized on a sentence-by-sentence basis. However, it is also possible to use an adaptation scheme which simultaneously transforms all data from a given speaker to some target range. This could be brought about, for example, by calculating the average pitch over all of the data from a speaker and divide each pitch value by that average (rather than calculating the average for each sentence and dividing each pitch value within the sentence by that average).

Hereinabove, the use of at least one embodiment of the present invention in a concatenative text-to-speech system is discussed. However, it is to be understood that essentially any method of producing synthetic speech, for example formant synthesis or phrase splicing, could also make use of at least one embodiment of the invention by including data from multiple speakers in the database of speech used to build those systems.

It is to be understood that the present invention, in accordance with at least one presently preferred embodiment, includes an obtaining or collector arrangement which obtains information or data from speakers, and a pooling arrangement or target range creator. Together, the obtaining/collector arrangement and pooling arrangement/target range creator may be implemented on at least one general-purpose computer running suitable software programs. These may also be implemented on at least one Integrated Circuit or part of at least one Integrated Circuit. Thus, it is to be understood that the invention may be implemented in hardware, software, or a combination of both.

If not otherwise stated herein, it is to be assumed that all patents, patent applications, patent publications and other publications (including web-based publications) mentioned and cited herein are hereby fully incorporated by reference herein as if set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. A method of constructing a model for use in a text-to-speech synthesis system, said method comprising the steps of:

providing a first input of speech from a first training speaker, the first input of speech including at least one sentence;

providing a second input of speech from a second training speaker, the second input of speech including at least one sentence;

obtaining a first set of features and a first corresponding observation value from the first input of speech;

said step of obtaining a first set of features and a first corresponding observation value including tracking pitch over each sentence;

obtaining a second set of features and a second corresponding observation value from the second input of speech;

said step of obtaining a second set of features and a second corresponding observation value including tracking pitch over each sentence; and pooling said first and second corresponding observation values to obtain the model.

2. A method of constructing a model for use in a text-to-speech synthesis system, said method comprising the steps of:

providing a first input of speech from a first training speaker, the first input of speech including at least one sentence;

providing additional inputs of speech from a plurality of additional training speakers, the additional inputs of speech each including at least one sentence;

obtaining a set of features and a corresponding observation value from the first input of speech;

said step of obtaining a first set of features and a first corresponding observation value including tracking pitch over each sentence;

repeating said step of obtaining a set of features and a corresponding observation value, including tracking pitch over each sentence, for each of the plurality of additional inputs of speech;

pooling said corresponding observation values, from said first speaker and said additional speakers, to obtain the model.

3. A method for enrolling training data for a text-to-speech synthesis system, said method comprising the steps of:

collecting speech data from at least two speakers, the speech data from each speaker including at least one sentence;

ascertaining at least one characteristic relating to the speech data of each speaker;

said ascertaining step comprising tracking pitch over each sentence; and creating a target range of speech data via transforming the at least one characteristic relating to the speech data of each speaker.

4. The method according to claim 3, wherein said ascertaining step comprises obtaining a set of features and a corresponding observation value from each of said at least two speakers.

5. The method according to claim 4, wherein said step of creating a target range comprises pooling the observation values obtained from each of said at least two speakers.

6. The method according to claim 4, wherein said step of creating a target range of speech data further comprises normalizing the observation values obtained from each of said at least two speakers.

7. The method according to claim 6, wherein:

the observation values comprise pitch values; and said normalizing step comprises calculating average pitch over a predetermined quantity of speech data and thence obtaining normalized pitch values via dividing each pitch value within the predetermined quantity of speech data by said average.

8. The method according to claim 7, wherein said transforming step comprises multiplying each normalized pitch value by a target pitch value, the target pitch value being the average pitch of a target speaker.

9. An apparatus for constructing a model for use in a text-to speech synthesis system, said apparatus comprising:

an input arrangement which provides:

a first input of speech from a first training speaker, the first input of speech including at least one sentence; and a second input of speech from a second training speaker, the second input of speech including at least one sentence;

an extracting arrangement which obtains a first set of features and a first corresponding observation value from the first input of speech;

said extracting arrangement being adapted to further obtain a second set of features and a second corresponding observation value from the input of speech;

said extracting arrangement being adapted to track pitch over each sentence; and a pooling arrangement which pools said first and second corresponding observation values to obtain the model.

10. An apparatus for constructing a model for use in a text-to-speech synthesis system, said apparatus comprising:

an input arrangement which provides:

a first input of speech from a first training speaker, the first input of speech including at least one sentence; and additional inputs of speech from a plurality of additional training speakers, the additional inputs of speech each including at least one sentence;

an extracting arrangement which obtains a set of features and a corresponding observation value from the first input of speech;

said extracting arrangement being adapted to further obtain a set of features and a corresponding observation value for each of the plurality of additional inputs of;

said extracting arrangement being adapted to track pitch over each sentence; and a pooling arrangement which pools said corresponding observation values, from said first speaker and said additional speakers, to obtain the model.

11. An apparatus for enrolling training data for a text-to-speech synthesis system, said apparatus comprising:

an input arrangement which collects speech data from at least two speakers, the speech data from each speaker including at least one sentence;

an ascertaining arrangement which ascertains at least one characteristic relating to the speech data of each speaker;

said ascertaining arrangement being adapted to track pitch over each sentence; and a target range creator which creates a target range of speech data via transforming the at least one characteristic relating to the speech data of each speaker.

12. The apparatus according to claim 11, wherein said ascertaining arrangement is adapted to obtain a set of features and a corresponding observation value from each of said at least two speakers.

13. The apparatus according to claim 12, wherein target range creator is adapted to pool the observation values obtained from each of said at least two speakers.

14. The apparatus according to claim 12, wherein said target range creator comprises a normalizer which normalizes the observation values obtained from each of said at least two speakers.

15. The apparatus according to claim 14, wherein:

the observation values comprise pitch values; and said normalizer is adapted to calculate average pitch over a predetermined quantity of speech data and thence obtain normalized pitch values via dividing each pitch value within the predetermined quantity of speech data by said average.

16. The apparatus according to claim 15, wherein said target range creator is adapted to multiply each normalized pitch value by a target pitch value, the target pitch value being the average pitch of a target speaker.

17. A program storage device readable by machine, tangibly embodying a program of instructions executable by the machine to perform method steps for constructing a model for use in a text-to-speech synthesis system, said method comprising the steps of:

providing a first input of speech from a first training speaker, the first input of speech including at least one sentence;

providing a second input of speech from a second training speaker, the second input of speech including at least one sentence;

obtaining a first set of features and a first corresponding observation value from the first input of speech;

said step of obtaining a first set of features and a first corresponding observation value including tracking pitch over each sentence;

obtaining a second set of features and a second corresponding observation value from the second input of speech;

said step of obtaining a second set of features and a second corresponding observation value including tracking pitch over each sentence; and pooling said first and second corresponding observation values to obtain the model.

18. A program storage device readable by machine, tangibly embodying a program of instructions executable by the machine to perform method steps for enrolling training data for a text-to-speech synthesis system, said method comprising the steps of:

collecting speech data from at least two speakers, the speech data from each speaker including at least one sentence;

ascertaining at least one characteristic relating to the speech data of each speaker;

said ascertaining step comprising tracking pitch over each sentence; and creating a target range of speech data via transforming the at least one characteristic relating to the speech data of each speaker.

* * * * *